United States Patent [19]

Crookston, Sr.

[11] Patent Number: 5,069,950

[45] Date of Patent: Dec. 3, 1991

[54] INSULATED ROOF BOARD

[75] Inventor: Anthony J. Crookston, Sr., Akron, Ohio

[73] Assignee: Old Reliable Wholesale, Inc., Barberton, Ohio

[21] Appl. No.: 508,066

[22] Filed: Apr. 11, 1990

[51] Int. Cl.[5] ..... B05B 5/00

[52] U.S. Cl. ..... 428/156; 428/158; 428/160; 428/166; 428/167; 52/199; 52/302; 52/303

[58] Field of Search ..... 428/158, 156, 159, 160, 428/166, 167, 314.4, 314.8, 47; 52/199, 302, 303, 309.9

[56] References Cited

U.S. PATENT DOCUMENTS

| | | | |
|---|---|---|---|
| 3,000,144 | 9/1961 | Kitson | 428/159 |
| 3,016,317 | 1/1962 | Brunner | 428/158 |
| 3,126,978 | 3/1964 | Bergstrom | 428/314.4 |
| 3,135,069 | 6/1964 | Schuller et al. | 50/196 |
| 3,387,420 | 6/1968 | Long | 428/167 |
| 3,455,076 | 7/1969 | Clarvoe | 428/167 |
| 3,598,688 | 8/1971 | Bellamy | 161/92 |
| 3,619,961 | 11/1971 | Sterrett et al. | 52/302 |
| 3,763,614 | 10/1973 | Hyde et al. | 52/309 |
| 3,817,009 | 6/1974 | Elder | 52/199 |
| 4,021,981 | 5/1977 | VanWagoner | 52/309 |
| 4,189,886 | 2/1980 | Frohlich et al. | 52/302 |
| 4,651,494 | 3/1987 | VanWagoner | 52/593 |
| 4,712,349 | 12/1987 | Riley | 52/199 |
| 4,804,578 | 2/1989 | Crookston | 428/304.4 |

FOREIGN PATENT DOCUMENTS

| | | | |
|---|---|---|---|
| 3407184 | 9/1984 | Fed. Rep. of Germany | 428/158 |
| 2068385 | 8/1971 | France | 52/302 |
| 0017249 | 2/1981 | Japan | 428/158 |
| 0961133 | 6/1964 | United Kingdom | 52/302 |

*Primary Examiner*—James J. Seidleck
*Assistant Examiner*—Nasser Ahmad
*Attorney, Agent, or Firm*—Oldham & Oldham Co.

[57] ABSTRACT

A composite insulated roof board structure comprising a light-weight insulated roof board member having good thermal insulation properties and a protective top layer which overlies the insulated roof board member. The insulated roof board member comprises a main portion of rigid coherent solid insulating material, such as polyisocyanurate or expanded polystyrene, and a top portion comprising a plurality of spaced blocks above the main portion and integral therewith. The blocks form therebetween a network of interconnected channels which are at the same level for horizontal venting of water vapor to all peripheral edges of the roof board member. The blocks are typically square and the channels are typically in the form of two sets of mutually perpendicular channels. The roof board composite is typically formed as a panel of rectangular shape. A plurality of vents at predetermined intervals may be provided for venting water vapor vertically, in addition to the horizontal venting which takes place via the aforesaid channels.

7 Claims, 1 Drawing Sheet

INSULATED ROOF BOARD

TECHNICAL FIELD

This invention relates to roof structures and more particularly to an improved insulated roof board which provides good insulation, permits venting of water vapor, and is light in weight and yet strong.

BACKGROUND ART

Various roofing structures and systems are known. The object of most roofing systems is to provide insulation for the building which the roof covers, to keep the building dry, and yet to prevent water vapor from accumulating within the roofing system or structure. Accumulation of water vapor is damaging or destructive to the roofing system. Yet it is difficult to keep water out of the building and at the same time to prevent build-up of water vapor within the roofing structure. In addition, the roofing systems must be strong enough to support any wind load and snow loads to which it is subjected, to permit a person to walk on the roof, and (where desired) support an aesthetically pleasing exterior member which constitutes the top layer of the roofing structure. Existing roofing systems achieve the aforesaid objects with varying degrees of success. In some cases there is a tradeoff in which performance in one area is sacrificed in order to achieve top performance in another area. In particular, it is difficult to keep a building dry and at the same time to prevent the build-up of water vapor within the roofing structure. Various constructions have been proposed in order to achieve both objects.

Applicant's U.S. Pat. No. 4,804,578 discloses an insulated roof board comprising a base layer of rigid coherent insulating material, an intermediate layer comprising a plurality of small shaped bodies, preferably polystyrene beads, which are adhesively joined together and which provide void space for lateral venting of water vapor, and a relatively hard, dense top layer. The base layer is preferably made of a foam plastic insulating material such as polystyrene. The hard dense top layer is a protective layer preferably made of a coherent cellulosic material such as fiber board or hard board. Also shown is a roofing assembly which incorporates the aforesaid insulated roof board. While the insulated roof board shown therein is light in weight, strong, and highly effective in venting water vapor, it is comparatively expensive to manufacture because of the cost associated with forming the intermediate layer, which requires adhesively securing to each other and to the base layer a large number of shaped bodies such as the aforesaid polystyrene beads.

Sterrett et al U.S. Pat. No. 3,619,961 discloses a foamed polystyrene insulation board having grooves extending in one direction along the top and bottom surfaces thereof, and at least one channel extending horizontally along an edge of the board in a direction transverse to the direction of the grooves. The channel is at an elevation intermediate between the elevations of the grooves, the top and bottom edges of the channel lying in parallel planes which are the respective planes of the troughs of the top set and the bottom set of grooves. While the channel is in communication with the grooves, communication is in the vertical direction only, i.e., across the aforesaid planes at the places of intersection. The channel and the grooves permit venting of water vapor. The polystyrene board may be situated on a suitable base member such as concrete, and on top of this board may be placed an additional insulating layer (e.g., lightweight insulating concrete) and a water impermeable (e.g., bituminous coating roofing felt) top layer.

Hyde et al U.S. Pat. No. 3,763,614 discloses a roof construction which includes a thermal insulating layer having fissures therein. A protective layer is disclosed on the top surface of the thermal insulating layer. Below this insulating layer are (in descending order) a water impermeable membrane, a second insulating layer and a metal roof deck.

Van Wagoner U.S. Pat. No. 4,021,981 discloses a roofing systems which comprises an insulation course and a protective layer, the former being placed atop of a vapor impermeable membrane. The insulation course may be made of an expanded foam, e.g., polyurethane or a polystyrene, glass beads, insulating concrete, or bituminous blocks. The protective course is a fire-retardant material which is water but not vapor impermeable. Various materials are suggested, and a fiberglass reinforced surface bonding cement containing an acrylic polymer emulsion additive is preferred.

Schuller et al U.S. Pat. No. 3,135,069 and Frohlich et al U.S. Pat. No. 4,189,886 show other roofing structures with various layers through which air and water vapor may pass.

Bellemy U.S. Pat. No. 3,598,688 shows a roofing construction which includes a waterproof layer and a resistant layer having vent openings therethrough at periodic intervals.

While various roofing constructions have been proposed, none except that shown in applicants aforementioned U.S. Pat. No. 4,804,578 has fully achieved the various desired characteristics of a roofing system, and the roof board therein (as well as other insulated roof constructions employing polystyrene beads) have relatively high manufacturing costs.

DISCLOSURE OF THE INVENTION

The present invention provides a novel improved insulated roof board which provides good insulation, is light in weight and yet strong, and prevents the build-up of water within the roofing structure.

The insulated roof board of this invention is a composite structure which comprises an insulating roof board member which in turn includes a main portion of rigid coherent solid insulating material and a top portion comprising a plurality of spaced blocks above the main portion and integral therewith, said blocks defining therebetween a network of interconnected channels for 360° horizontal venting of water vapor; and a protective top layer overlying said insulated roof board member. This invention according to a further aspect provides a novel insulated roof board member as above described.

This invention according to a still further aspect provides a roof assembly, the aforesaid insulated roof board structure, a water vapor impermeable layer formed on top of the aforesaid protective layer, and a plurality of spaced vents for venting water vapor vertically. Some of these vents are equipped with motor driven blowers.

BRIEF DESCRIPTION OF THE DRAWINGS

This invention will now be described in further detail with reference to a preferred embodiment thereof, as shown in the accompanying drawing.

In the Drawings.

BEST MODE FOR CARRYING OUT INVENTION

Figure 1:
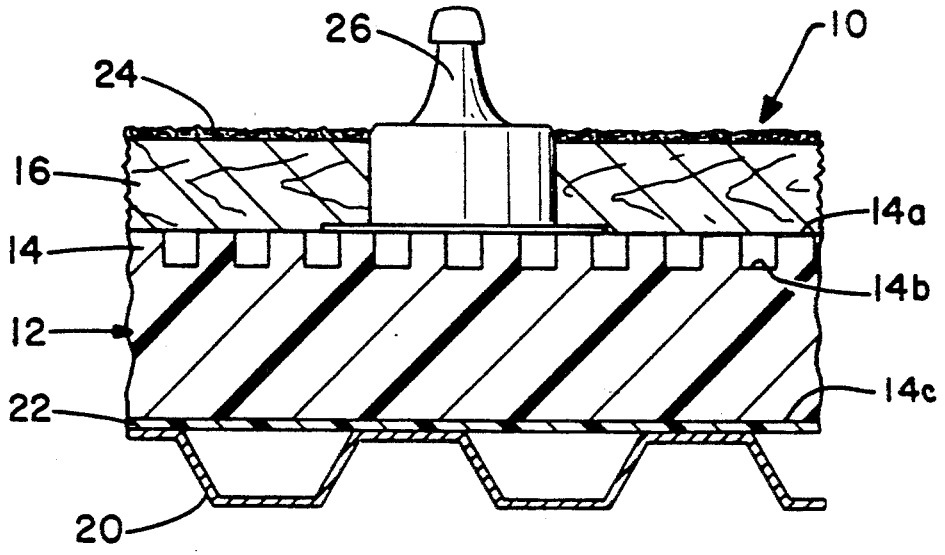
FIG. 1 is a vertical sectional view, with parts broken away, of the roof assembly including an insulated roof board structure according to this invention.

A roofing assembly according to this invention is shown in FIG. 1. This roofing assembly includes an insulated roofboard 10, which is a composite structure comprising an insulated roofboard member 12 of rigid, coherent lightweight insulating material, and a protective top layer 16.

Figure 2:
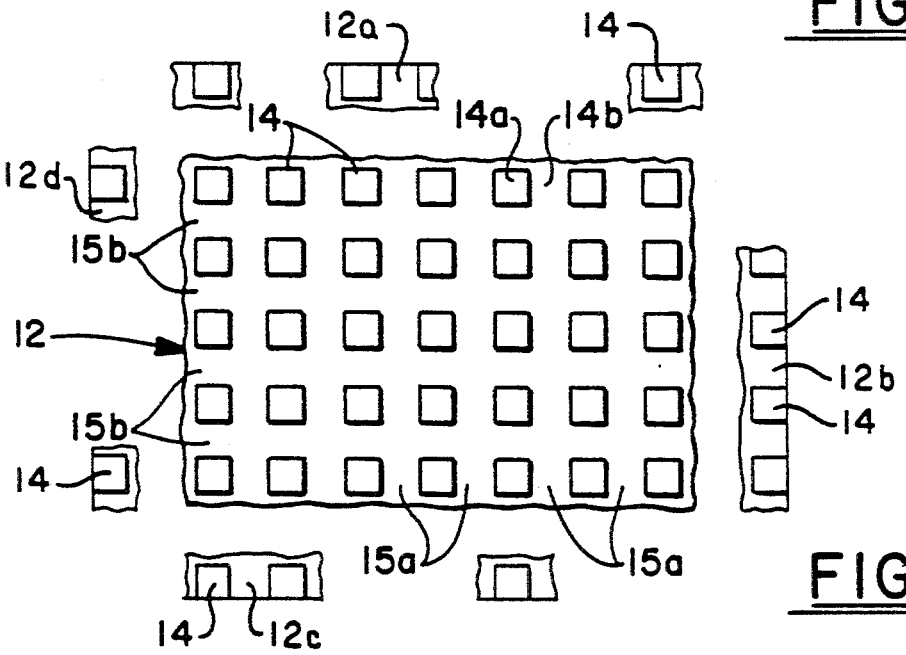
FIG. 2 is a top view of an insulated roof board member according to this invention.
Figure 3:
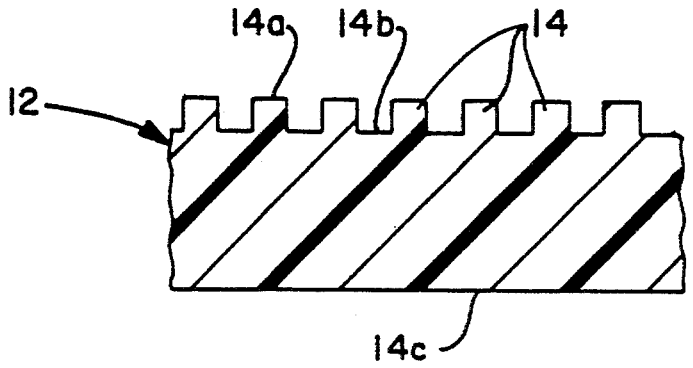
FIG. 3 is a front elevational view of an insulated roof board member according to this invention.

The structure of insulated roof board member 12 is shown more fully in FIGS. 2 and 3. This member is preferably made of a foamed plastic insulating material such as polyisocyanurate (which is preferred) polystyrene (e.g., expanded polystyrene or EPS) and polyurethane. Either 1 pound or 2 pound grades of expanded polystyrene can be used. All of these materials are rigid, light in weight and yet strong, and have high R values, which denotes that they are good thermal insulators. These materials are cellular in nature, either open or closed cell, typically comprising a large number of tiny air cells which do not communicate with the outside, as is well known. Alternatively, but less desirably, other lightweight insulating materials may be used in place of a rigid foamed plastic material.

Insulation member 12 is preferably rectangular in shape and formed from a rectangular block of the desired insulating material having edges 12*a*, 12*b*, 12*c*, and 12*d*. These include two pairs of peripheral edges, i.e., 12*a*, 12*c* and 12*b*, 12*d*. This insulation member comprises a main portion, which is preferably in rectangular block form, with no air channels cut either through it or along any of its surfaces or edges, and a top portion comprising a plurality of spaced blocks 14 above said main portion. Blocks 14 are an integral part of insulation member 12, i.e. they are either integrally formed with or integrally joined to insulation member 12. These blocks, which are dividers or separators, define therebetween a network of interconnected channels for horizontal venting of water vapor to the edges of the insulation member. In the preferred embodiment, blocks 14 are square in shape as seen from above, and have vertical sides. The tops of blocks 14 are flat and lie in a common plane 14*a* which is the top plane of the roof board member 12 as a whole. The bases of blocks 14 lie in a common plane 14*b*. The distance between blocks 14 is preferably equal to their width. Thus blocks 14 define a plurality of parallel channels 15*a* extending in one direction and a second plurality or set of channels 15*b* extending in a direction at right angles thereto. These channels may be parallel to the Y direction and the X direction, respectively, of board member 12. Both sets of channels are disposed at the same level or elevation, i.e., both lie between top plane 14*a* and intermediate plane 14*b* of the board member 12. The channels extend to all peripheral edges of the board member so as to provide 360° horizontal or lateral venting of water vapor. The main portion of insulated board member 12 extends from intermediate plane 14*b* to the bottom plane 14*c* of board member 12.

Preferably the width of blocks 14 and the widths of channels 15*a* and 15*b* therebetween are the same. Thus, for example, blocks 14 may be 1½ inches square and channels 15*a* and 15*b* may be 1½ inches wide. Alternatively blocks 14 may be 3.2 inches square and channels 15*a*, g 15*b* may be 3.2 inches wide. For greater structural strength, channel widths not over 1.5 inches are preferred. When the blocks and channels are of the same width, approximately ¾ of the area of the top portion of board member 12 is channel space, which affords excellent horizontal venting. Board member 12 may be formed by cutting away portions thereof, as for example with a hot wire, to form the desired configuration of blocks and channels. A saw may be used if the melting point of the insulating material is too high for use of the hot wire. Alternatively, a plurality of blocks 14 may be formed separately and adhered to a rectangular solid block of the insulating material, as for example with an adhesive or by melting at the interface or by other known means. That method is much more laborious and expensive, however, than the preferred method of cutting out the desired channel pattern. In either case, the insulated roof board member 12 when fully formed comprises a lower portion in block form with a plurality of blocks 14 defining therebetween a plurality of channels 15*a* and 15*b* which extend horizontally in at least two (2) directions and as shown here at right angels to each other.

It will be appreciated that the blocks (or separators or dividers) can be of any desired shape so as to give any desired channel pattern comprising either curved or straight channels, It is important, however, that the channels be at the same level or elevation, and not at different elevations as for example in U.S. Pat. No. 3,619,961, in order to provide free communication between the channels.

It will be observed that the single piece insulator board 12 herein replaces both the base layer and the beads thereabove as shown in applicant's U.S. Pat. No. 4,804,578. The advantages of the structure herein include lower manufacturing cost and greater compressive strength both resulting from the single piece nature of board member 12 as compared to the multiplicity of pieces (one block forming the base member and a large number of beads thereabout) in the construction shown in U.S. Pat. No. 4,804,578.

The roofing assembly of this invention also includes a protective top layer 16, which overlies the block 14 and channels 15*a* and 15*b* and is adhered to the top of the former along plane 14*a*. g The top layer 16 is preferably a relatively hard, dense protective layer. Top layer 16 protects the roof board member 12 from moisture and impact. Top layer 16 should be strong enough to permit persons (workmen for example) to walk around on it and to support any desired roofing structure (such as roofing shingles and a supporting framework therefor). Top layer 16 should be a material which is capable of receiving additional roofing materials, such as a multiple ply built-up asphalt roof (not shown). Preferred materials for top layer 16 are cellulosic materials, and especially coherent particulate cellulosic materials such as bagasse, fiberboard, hardboard and particle board. Plywood may also be used. The desired structural strength, impact resistance, fire retardancy, ability to receive a coating and other desired characteristics can be obtained with either plywood or a coherent particulate cellulosic material as before described. Lightweight materials, such as expanded polystyrene, having two pound density may be used in some situations, depending on the compressive strength required and that afforded by the configuration of blocks and channels. It will be readily apparent that a configuration comprising relatively large blocks with narrow channels will give more support to the top layer 16 than will a configuration comprising smaller blocks and relatively wider channels, and thereby make possible the use a material (such as a polystyrene) having lower compressive strength than that of the aforesaid cellulosic materials.

The thickness of an insulated roof board composite (including board member 12 and a top layer 16) may range from about 1.5 to about 4 inches. The heat insulation value increases with increase in thickness, as is readily apparent. While the upper portion of board member 12 (between planes 14*a* and 14*b*) affords some heat insulation, since air is a good insulator and blocks 14 are normally of the same insulating material as the main portion of board member 12, the main portion of board member 12 (between plane 14*b* and the bottom plane would normally be thick enough to afford the entire R value required. A representative composite roof board structure according to this invention, may include a board member 12 having a thickness of about 2.5 inches, with channels 15*a* and 15*b* which are about 1.25 inches deep so that the thickness of the lower portion of the board member is about 1.25 inches. On the other hand, the lower portion may constitute a greater portion of the total thickness of board member 12, as shown in the drawings. The top layer 16 may be about 0.5 inch thick. These dimensions are merely representative and may be varied.

The length and width of an insulated roof board composite comprising insulated roofboard member 12 and top layer 16 may be as desired. For example, the composite board may be provided in the form of panels 4 feet by 8 feet, or in the form of square panels 4 feet by 4 feet. The composite is usually rectangular (including square). Alternatively, the board may be provided in the form of larger or smaller panels. Other suitable sizes, by way of example, include 3×3 feet and 10×10 feet. The composite of this invention is easily cut, either precut or cut on the job site, to desired roof dimensions.

The roof board of this invention is particularly useful in flat roofs or decks. However, it may also be used in pitched roofs and walls. When used in walls, the insulated board member 12 is toward the interior of the building and "top" layer 16 is toward the outside. When used in roofs, the top layer 16 is above the board member 12.

The insulated roof board of this invention may be placed on top of conventional roofing structures, as for example, on top of a concrete slab as shown for example in U.S. Pat. No. 3,619,961, or on top of a wooden deck as shown for example in U.S. Pat. No. 3,135,069. The roof board may be secured to the supporting structure underneath by conventional means, such as bituminous material which is hot when applied. The roofing deck underneath the roof board may include a watertight member, such as a corrugated metal shown in U. S. Pat. No. 4,021,981.

A representative roofing assembly according to this invention is shown in FIG. 1. Referring to FIG. 1, such roofing assembly may include (going upwardly in the order named) a roof deck, e.g. a corrugated metal sheet 20, a water and vapor impermeable membrane 22 (which is optional), and an insulated roof board composite according to this invention, which as previously noted includes an insulated board member 12 and a protective layer 16 thereabove. Water and vapor impermeable membrane 22, when present, may be adhered to roof deck 20 and to the insulated board member 12 by suitable means, such as a screw or clip, or by an adhesive such as an asphalt-, bituminous- or rubber-base adhesive. Suitable adhesives are known in the roofing art. However, this water and vapor impermeable membrane 22 usually is not necessary.

A layer 24 of waterproofing material, such as asphalt or bitumen, or rubber, may be placed on top of top layer 16. This layer keeps out rain or snow but is not water vapor impermeable. This material, when it sets, may form a roofing membrane, depending on the material chosen. Suitable materials for this purpose are well known in the art, and are customarily applied at the job site.

The roofing structure above the insulated roof board may be conventional. For example, one may apply, as the exterior surface layer, an aesthetically pleasing material (shingles, for example) supported by a suitable structure such as plywood, above the insulated roof board. Such superstructure may be attached by mechanical means or by an adhesive coating (e.g. the aforesaid adhesive coating 24). Alternatively, coating 24 may serve as the exterior surface layer.

A plurality of roof boards (enough to span the entire roof) may be laid in side-by-side relationship with the edge of each board touching the adjacent edges of the adjacent boards.

A plurality of vertical vents 26, which may be conventional, may be placed at desired intervals (e.g. one every 700 square feet). Some of these vents 26 should include a motor-driven blower (not shown). Preferably all of the vents 26 are capable of being retrofitted with a blower and motor therefor. Vents 26 preferably extend through the top layer 16 and terminate at the top plane 14*a* of roofboard member 12. In this way they draw water vapor from channels 15*a*,15*b* upwardly. Vents 26 may be arranged in any suitable manner, as for example either a square arrangement (similar to that shown in U.S. Pat. No. 4,804,578) or in a triangular arrangement.

The various substructures below the roof board and superstructures above roofboard 10 disclosed herein, are merely by way of example and not by way of limitation. These are cited to show how the present roof board may be integrated with conventional roofing materials and construction.

The insulated roof board of this invention efficiently vents water vapor to the atmosphere while keeping out water in the form of rain or snow. A problem with presently known insulation constructions (other than that shown in U.S. Pat. No. 4,804,578) is that water may condense between the insulation and the water and vapor impermeable membrane, then vaporize later due to the heat of the sun. As the water vaporizes, it expands greatly. The resulting water vapor pressure between the membrane and the insulation manifests itself by blistering the membrane surface and separating the plies in built up membrane constructions. This water vapor and any undispersed moisture within the insulation will cause premature membrane failure and will ultimately cause deck failure by rotting or rusting. The present roof board and roofing assembly avoids this. Any water which condenses between the roof board and membrane 22 (when present), or between the roof board and deck 20 (when membrane 22 is absent) and which later vaporizes, escapes laterally to the atmosphere through the channels 15*a* and 15*b*. Such escape may be assisted by vents 26 as aforedescribed.

The roof board of the present invention is very strong, yet light in weight. This board, having the preferred materials and dimensions indicated, will support a load of 800 pounds per square foot. The weight of this preferred roofboard varies somewhat according to the insulation material chosen. For example, a very light and yet strong roof board is attained using expanded polystyrene (EPS) having a 1 pound density (1.0 lb./sq.ft.). This is a widely used grade of EPS for insulation purposes. Somewhat greater compressive strength with slightly greater R value is obtained by using two pound EPS (2.0 lb./sq.ft.). In addition, the roof board of this invention keeps moisture out of the building, yet permits efficient venting of water vapor from the roofing structure. Above all, the roof board has outstanding insulation properties.

While in accordance with the patent statutes, a preferred embodiment and best mode has been disclosed in detail, the scope of the invention is not limited thereto, but is rather measured by the scope of the attached claims.

What is claimed is:

1. A composite insulated roof board structure comprising:

(a) an insulated roof board member comprising (1) a main portion of rigid coherent solid insulating material, and (2) a top portion comprising a plurality of spaced blocks above said main portion and integral therewith, said blocks defining therebetween a network of interconnected channels at the same level for horizontal venting of water vapor; and (b) a relatively hard, dense protective top layer which is adhered to the tops of the blocks of said insulated roof board member.

2. A composite structure according to claim 1, said structure having a plurality of peripheral edges and said channels extending to all of said peripheral edges.

3. A composite structure according to claim 1, said structure being in the form of a rectangular panel having two pairs of opposite parallel peripheral edges and said channels including a first set which are parallel to one of said pairs of peripheral edges and a second set which are parallel to the other said pairs of peripheral edges.

4. A composite structure according to claim 3 wherein said blocks are square.

5. A composite structure according to claim 4 wherein said blocks and said channels are of the same width.

6. A composite structure according to claim 1 in which said solid insulating material is a lightweight material.

7. A composite structure according to claim 1 in which said solid insulating material is a lightweight cellular material.

* * * * *

US005069950C1

(12) EX PARTE REEXAMINATION CERTIFICATE (7712th)

United States Patent

Crookston, Sr.

(10) Number: US 5,069,950 C1

(45) Certificate Issued: Sep. 7, 2010

(54) INSULATED ROOF BOARD

(75) Inventor: Anthony J. Crookston, Sr., Akron, OH (US)

(73) Assignee: Old Reliable Wholesale, Inc., Barberton, OH (US)

Reexamination Request:
No. 90/009,258, Aug. 20, 2008

Reexamination Certificate for:

| | |
|---|---|
| Patent No.: | **5,069,950** |
| Issued: | **Dec. 3, 1991** |
| Appl. No.: | **07/508,066** |
| Filed: | **Apr. 11, 1990** |

(51) Int. Cl.

| | |
|---|---|
| ***E04D 13/00*** | (2006.01) |
| ***E04D 13/17*** | (2006.01) |

(52) U.S. Cl. ..... 428/156; 428/158; 428/160; 428/166; 428/167; 52/199; 52/302.1

(58) Field of Classification Search ..... None
See application file for complete search history.

(56) References Cited

U.S. PATENT DOCUMENTS

| | | | | |
|---|---|---|---|---|
| 3,003,810 | A | 10/1961 | Kloote | |
| 3,343,474 | A | 9/1967 | Sohda | |
| 3,368,473 | A | 2/1968 | Sohda | |
| 3,387,420 | A | 6/1968 | Long | 52/302 |
| 3,455,076 | A | 7/1969 | Clavoe | 52/302 |
| 3,817,009 | A | 6/1974 | Elder | 52/173 |
| 4,397,126 | A | 8/1983 | Nelson | 52/199 |
| 4,489,531 | A | 12/1984 | Nelson | 52/741 |
| 4,492,064 | A | 1/1985 | Bynoe | 52/309.8 |
| 4,534,119 | A | 8/1985 | Glicksman | 52/95.9 |
| 4,635,419 | A | 1/1987 | Forrest | |
| 4,635,423 | A | 1/1987 | Ward | |
| 4,677,800 | A | 7/1987 | Roodvoets | 52/309.12 |

FOREIGN PATENT DOCUMENTS

| | | | |
|---|---|---|---|
| CA | 712 301 | 6/1965 | 20/50 |
| FR | 2573458 | 5/1986 | |
| RU | 775 258 | 10/1980 | |

OTHER PUBLICATIONS

Cornell Corporation, Vent–Toy Thermal Cal. Installation Instr. Nov. 1987, pp. 1–2.

Cornell Corporation Vent–Top ThermCal—Installation Instr. Mar. 1988 pp. 1–2.

Cornell Corporation ThermaCal—Vent–Top Therm Cal brochure, 1988, pp. 1,2,4.

Cornell Coporation Vent–Top ThermaCal brochure, 1989, pp. 1–4.

Branch River Foam Plastics, Elmes letter to Tonnancous, Mar. 23, 1887 with attachment of Air—Flo Panel System Installation Instr, and Construction Details, Mar. 23, 1987, pp. 1–3.

*Primary Examiner*—Terrence R Till

(57) ABSTRACT

A composite insulated roof board structure comprising a light-weight insulated roof member having good thermal insulation properties and a protective top layer which overlies the insulated roof board member. The insulated roof board member comprises a main portion of rigid coherent solid insulating material, such as polyisocyanurate or expanded polystyrene, and a top portion comprising a plurality of spaced blocks above the main portion and integral therewith. The blocks form therebetween a network of interconnected channels which are at the same level for horizontal venting of water vapor to all peripheral edges of the roof board member. The blocks are typically square and the channels are typically in the form of two sets of mutually perpendicular channels. The roof board composite is typically formed as a panel of rectangular shape. A plurality of vents at predetermined intervals may be provided for venting water vapor vertically, in addition to the horizontal venting which takes place via the aforesaid channels.

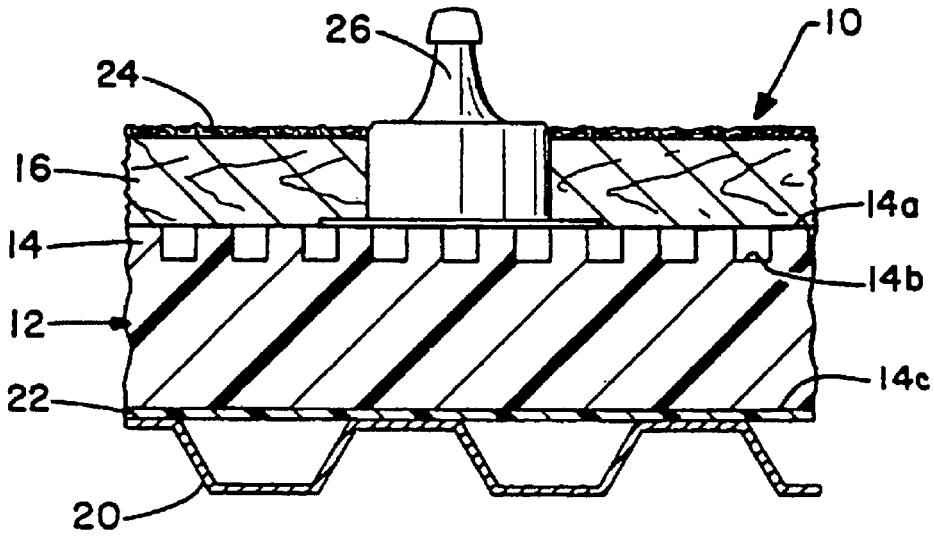

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-7 is confirmed.

* * * * *